United States Patent [19]

Cicin-Sain

[11] 4,449,459

[45] May 22, 1984

[54] PIVOTING HEAD CONTINUOUS TAMPER

[75] Inventor: Ivo Cicin-Sain, Bussigny, Switzerland

[73] Assignee: Canron Corp., West Columbia, S.C.

[21] Appl. No.: 341,344

[22] Filed: Jan. 21, 1982

[30] Foreign Application Priority Data

Jan. 23, 1981 [CH] Switzerland ..... 428/81

[51] Int. Cl.[3] ..... E01B 27/16

[52] U.S. Cl. ..... 104/12

[58] Field of Search ..... 104/7 R, 7 B, 8, 12

[56] References Cited

U.S. PATENT DOCUMENTS

| | | | |
|---|---|---|---|
| 3,430,578 | 3/1969 | Stewart | 104/7 R |
| 3,608,496 | 9/1971 | Schenkir et al. | 104/12 |
| 3,653,327 | 4/1972 | Sauterel | 104/12 |
| 3,717,100 | 2/1973 | Sieke et al. | 104/12 |
| 3,762,333 | 10/1973 | Theurer et al. | 104/12 |
| 3,795,198 | 3/1974 | Plasser et al. | 104/12 |
| 3,892,183 | 7/1975 | von Beckman | 104/12 |
| 4,282,815 | 8/1981 | von Beckmann | 104/12 |

FOREIGN PATENT DOCUMENTS

| | | | |
|---|---|---|---|
| 350612 | 6/1979 | Austria . | |
| 57030 | 8/1982 | European Pat. Off. | 104/12 |
| 1067837 | 10/1959 | Fed. Rep. of Germany . | |
| 1932877 | 1/1971 | Fed. Rep. of Germany | 104/12 |
| 2095312 | 9/1982 | United Kingdom | 104/12 |
| 2094868 | 9/1982 | United Kingdom | 104/12 |
| 633971 | 11/1978 | U.S.S.R. | 104/12 |

*Primary Examiner*—Randolph Reese

*Attorney, Agent, or Firm*—Wenderoth, Lind & Ponack

[57] ABSTRACT

A track tamping machine particularly a track tamping, levelling and lining machine is equipped with at least one tamping unit including a carrier which carries tamping tools. The tamping unit is vertically movable on a sub-frame by means of a hydraulic cylinder and is fastened thereto. The sub-frame itself is suspended from the chassis of the tamping machine pivotably like a pendulum. The sub-frame has two guide columns guiding the tool carrier through its vertical motion and, at its lower end guide rollers which revolve on the rail for the purpose of centering the tamping unit. A control cylinder is activated for the purpose of swinging the tamping unit in such a way that while the machine is uniformly moving forward at constant speed, the tamping tools can perform their tamping function at subsequent ties.

12 Claims, 6 Drawing Figures

PIVOTING HEAD CONTINUOUS TAMPER

BACKGROUND OF THE INVENTION

The invention relates to a railway track tamping machine, especially a track levelling and aligning machine which is equipped with at least one ballast tamping unit which is longitudinally movably mounted on the machine frame and has at least one pair of co-operating tampers which are vertically adjustable.

Track tamping machines which proceed with a uniform velocity and on which intermittently working longitudinally movable tamping units are mounted are already known, see German published application No. 1,067,837 and U.S. Pat. No. 3,455,249. These machines are different from conventional track tamping machines which move in steps from tie to tie and, therefore, need to be accelerated very quickly as well as decelerated very quickly. Machines of which the frame is uniformly moved and on which only the tamping units have to move periodically, have the advantage that the masses to be accelerated and to be decelerated at each tamping cycle are considerably smaller than the step moving machines and the necessary energy and forces to move these masses are consequently smaller. Known uniform movement track tamping machines have tamping units longitudinally movable along the machine frame. Such arrangements are afflicted with adjustment problems. After completing the tamping of one tie and having lifted the tamping tools above the level of the rails, the tamping units have to be moved from the rear end position of the track travel on the machine chassis quickly into the front end position on the machine frame and be lowered into the track. During the succeeding tamping cycle the tamping units must be moved relative to the frame backwardly at a speed appropriate to the forward speed of the machine frame. The control of such relative movement and the adjustment of the tamping unit into the correct working position presents difficulties, particularly if the tamping unit is suspended in guides for sliding movement on the machine frame.

The same disadvantages are found in principle with another known track tamping, levelling and aligning machine see Austrian Patent No. 350,612 which comprises a main frame and an additional frame which is coupled to the main frame by a longitudinal moving device so that part of the machine can be moved with uniform speed and another part of the machine can be moved in step-wise sequence.

The present invention seeks to simplify the machine as well as the control of the workheads.

STATEMENT OF THE INVENTION

In accordance with the invention, the machine tamping unit is pivotable like a pendulum in a vertical plane of the machine frame about a lateral axis so as to be movable longitudinally of the track. This produces numerous advantages. The quick and accurate positioning of the tamping unit relative to the machine frame is much easier to realize, by swinging the tamping head about a fixed axis mounted on the frame than it would be by a translatory sliding motion of the tamping unit on guide rails. Furthermore, the torsional friction about an axis can be held lower than the friction of a tamping head being rolled forward and backward on guide rails. Acceleration forces are further considerably lower in the case of swinging the main masses of the tamping unit about a pivot as compared to a linear fore and aft movement of sliding tamping units. This is because only the lower portions of the tamping head has to move the entire stroke from tie to tie, whereas the main masses being closer to the pivot have less distance to travel. Finally, the space requirement for the pivotted workhead is less than the sliding type, especially in the upper area of the machine frame, since no space is required for the movement of the tamping unit.

In a preferred embodiment the tamping tools are mounted on a carrier and this carrier is vertically adjustable and mounted on a sub-frame which itself is movable about the lateral axis on the machine frame. The sub-frame may carry two columns which guide the carrier with the tamping tools thereon while it is being moved up and down; which columns may be equipped with rail-engaging guide rollers at the lower ends. In this way a continuous guide of the tamping unit is accomplished and lateral adjustment may be facilitated by the provision of a universal suspension of the sub-frame, that is, that in addition to being pivotable about the lateral axis, it is also possible to pivot the tamping unit about an axis oriented in the longitudinal direction of the machine frame. Such measure enables the sub-frame of the tamping unit to freely follow the motion of the guide rollers on the rail. Preferably, a hydraulic cylinder and piston arrangement is provided to control the longitudinal movement of the tamping frame which arrangement is, at one end fastened to the machine frame and at the other, to one of the columns.

Conveniently, the entire arrangement may be automated in such a way that the uniform forward velocity of the machine, being the average working velocity of the machine, is controlled as a function of the minimum duration of a tamping cycle, or, which amounts to the same thing, being a function of the distance between ties as detected by the tie detector.

DESCRIPTION OF THE DRAWINGS

The following is a description by way of example of certain embodiments of the present invention, reference being had to the accompanying drawings in which.

DESCRIPTION OF PREFERRED EMBODIMENT

Figure 1:
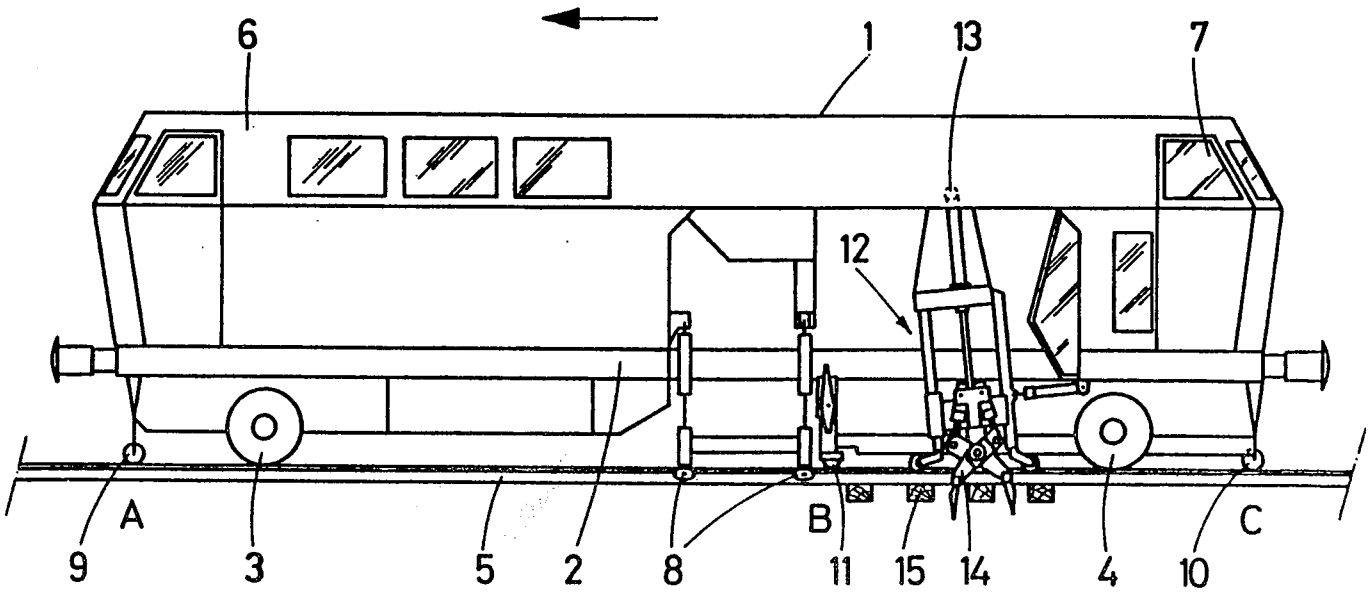
FIG. 1 is a schematic side view of a track tamping, levelling and aligning machine having a tamping head.

Referring now to the drawings. FIG. 1 shows a railway track tamping, levelling and aligning machine 1 with a frame 2 which machine, in operation, moves substantially uniformly in the direction of the arrow. The machine rolls on rail 5 on its front and rear wheels 3, 4 and is equipped with front and rear control cabins 6, 7. In the center area of frame 2 there are known levelling and aligning devices, operating through roller type clamps 8, by which rails 5 are levelled, that is, lifted to the desired elevation, and simultaneously aligned in lateral direction.

The control of the lifting and aligning jacks operating through roller type clamps 8 is effected automatically based on measurements provided by the lift and alignment reference system of the machine 1. The alignment reference system provides a measuring basis, which is defined by track reference points and which defines the desired track position. This requires the use of reference point A in the area of uncorrected track and, in the case of a straight line as a measuring basis, one reference point C in the area of already corrected track. In the case of a curve, the measuring basis is determined by two reference points, positioned in the already corrected track, of which the second is not shown in FIG. 1. The reference points A and C are defined by measuring wheels 9, 10 which are positioned at frame 2 of machine 1 and which revolve on rail 5; another reference point in the area of the corrected track can, for instance, be defined by a measuring device, following machine 1. The "as is" position of the rail 5 is measured in the vicinity of the machine track-working location at track measuring point B, defining by measuring wheel 11. Based on such measurement and the input from a surface condition reference system, of known type, the roller type clamps 8 with their lifting and aligning jacks, are controlled such that the track is positioned in its desired position as defined by the reference system.

A tamping unit 12 is mounted on the machine 1 behind roller clamps 8 which tamping unit is pivotably suspended from the lateral axis pivot 13 which is fastened to frame 2 so that tamping tools 14, in stepwise motions, tamps successive ties 15 while the machine moves forward at a uniform constant average working velocity and the roller clamps 8, being controlled by continuous measurements, lifts and laterally aligns the track to the desired elevation and postion. While the machine 1 is continuously and uniformly moving forward and the roller clamps 8 while rolling along rails 5 are in constant engagement with them, the tamping head 12, whose design and control shall be explained later, produces, during these work cycles, a fore and aft swing. Since rails 5 are constantly held and adjusted by roller clamps 8 a springback of the rails, which happens in the case of intermittent operation, is advantageously prevented.

Figure 2:
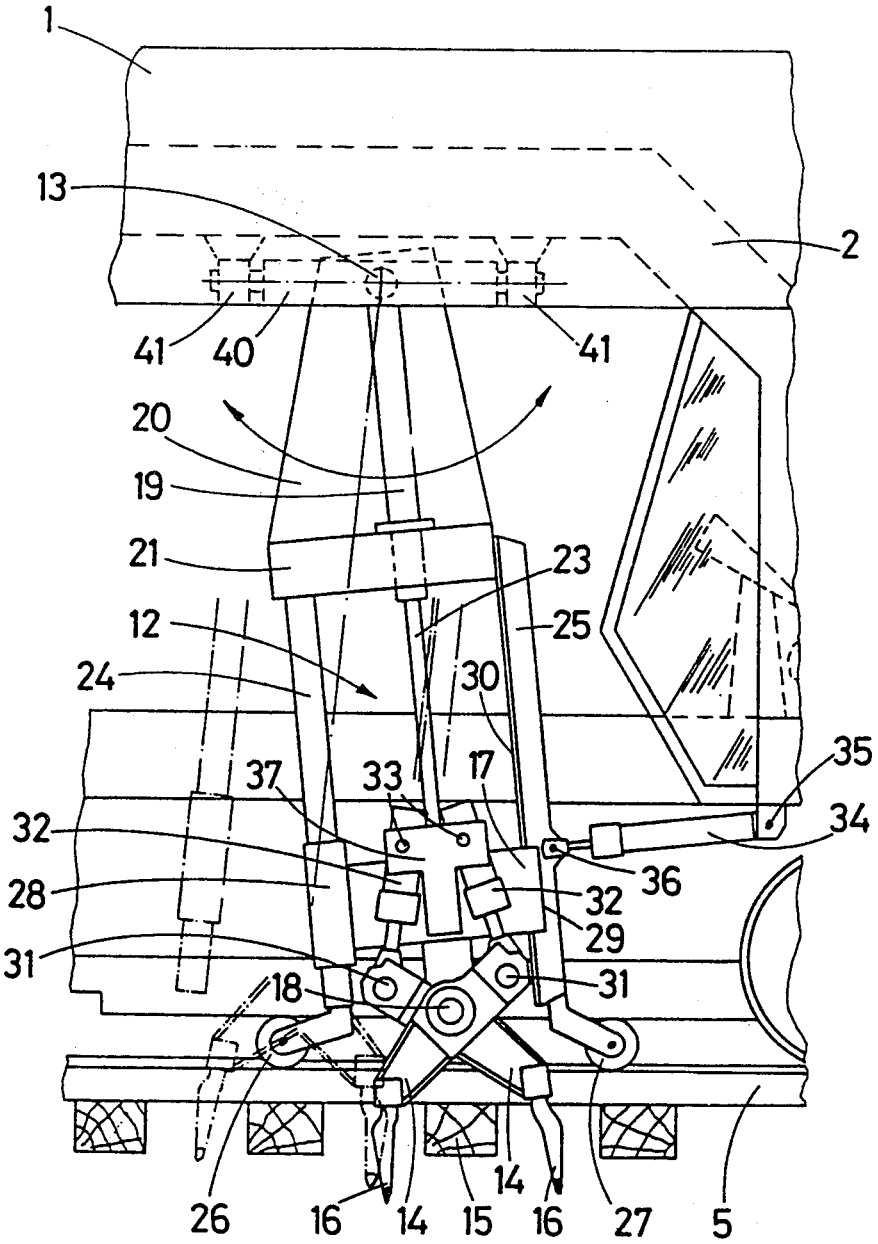
FIG. 2 is a view of the tamping head and its suspension from the machine main frame, in enlarged scale.

In FIG. 2, the nature of the tamping head 12 and its suspension is shown more clearly. The tamping head 12 has, on each side of rail 5, a pair each of cooperating tamping tool holders 14 which are movable in relation to each other and which are shown in FIG. 2 in their working position, with their tamping tools 16 on each side of tie 15 penetrated into the ballast. The tool holders 14 and tools 16 of each pair, in FIG. 1 only one can be seen, are linked to an eccentric on carrier 17 whereby tamping tool holders 14, designed as two armed levers, cross each other in the area of the eccentric shaft 18. Carrier 17 can be moved vertically by means of hydraulic cylinder 19 which is fastened to sub-frame 20, which itself as well as the upper end of the hydraulic cylinder 19 can swing about lateral axis pivot 13 which is mounted to chassis 2 positioned at right angles to the longitudinal direction of rail 5.

Sub-frame 20 has a cross beam 21 to which hydraulic cylinder 19 is fastened while carrier 17 is positioned at the lower end of piston rod 23 of the piston which is movable in the hydraulic cylinder 19.

To guide carrier 17 in its up and down movement, there are columns 24, 25 arranged in parallel to piston rod 23, which columns are mounted to the cross beam 21 of sub-frame 20. The lower ends of these columns carry guide rollers 26, 27 which revolve on rail 5. The rollers 26 are in roller-carriers which can be moved along columns 24, 25 longitudinally, while sub-frame 20 is swung through its motion, the roller-carriers working against springs. On one side of the carrier 17, the column 24 guides a guide bushing 28, while on the other side of carrier 17, a profiled guide 29 is provided, which profiled guide 29 slides along column 25, the column 25 providing a counter profile 30.

At the end of tamping tool holder 14 opposite tamping tool 16 of each tamping tool pair, a double acting hydraulic cylinder 32 is connected to links 31. The upper end of each cylinder 32 is connected to a link 33 at protrusion 37 of carrier 17. Operating hydraulic cylinders 32 causes the tamping tools 16 of each pair to spread or to approach each other. For the purpose of vibration, the tamping tools are further connected to eccentric bearings of the eccentric shaft 18 in such a way that with rotation of the eccentric shaft 18, tamping tools 16 will be brought into vibratory motion.

In order to control the pendulous movement of sub-frame 20 and tampers 12, there is a hydraulic control cylinder 34 provided, which cylinder 34 is linked on one side at 35 to chassis 2 and on the other at 36 to column 25. On extending the piston, the entire arrangement of tamping head 12 swings about lateral axis pivot 13 from the solid line position in FIG. 2 to the partially dotted position, while guide rollers 26, 27 roll along rail 5. Before such a swing is initiated, the tamper head 12 with its work tools 14 will, of course, be lifted by hydraulic cylinder 19 above the level of rail 5.

In order to achieve universal joint suspension of sub-frame 20, lateral axis pivot 13 rotates about longitudinal axis pivot 40 at right angles which longitudinal axis pivot is itself connected to bearings 41 and rotates in them. In this way sub-frame 20, with its tamping head 12, can also swing through its vertical plane about axis or shaft 40 so that it can freely follow the movements of guide rollers 26, 27 on rails 5 and thereby causes a self-adjustment or self-centering of workheads relative to rail 5.

In principle, of course, lateral axis shaft 13 could also be fixed to chassis 2.

An identically designed and suspended tamping head arrangement with two pairs of tamping tools is positioned in the area of the other rail (which cannot be seen in FIG. 2) and will tamp at that place simultaneously, the appropriate tie 15 on each side of the other rail.

The control of the described arrangement will be explained in accordance with the block diagram of FIG. 3 as well as the diagram of FIG. 4, which shows schematically the displacement of the workhead as a function of time. Time is shown as the abscissa, the ordinate being the vertical displacement H of the workhead. The considered example, shows the movement of one tamping cycle as a fixed preprogrammed rhythm. The forward velocity V of the machine will be controlled as a function of the minimum time required for one complete tamping cycle, or respectively—which amounts to the same thing—as a function of the measured tie distance, so that any idle time between the tamping cycles will be minimal or practically eliminated.

Figure 3:
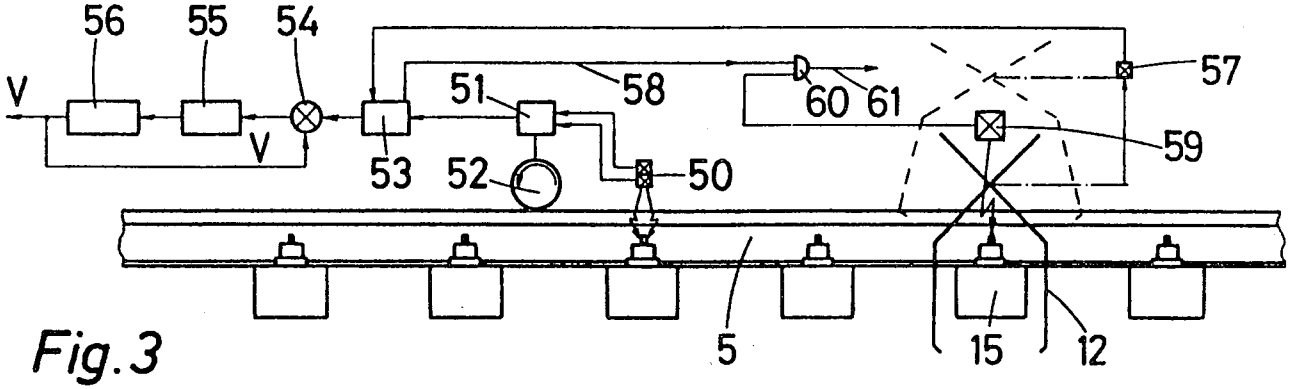
FIG. 3 is a block digram of a control system for the control of the tamping workheads and the forward velocity of the machine.

As seen in FIG. 3, the control and regulation system on the machine 1 has a tie detector 50, which, for example, could react to the metallic rail fastenings as in the fashion of an electromagnetic proximity detector; a distance and velocty meter 51 in the form of an impulse counter which counts the impulses created by impulse generator 52 at a wheel axle, or which measures the impulse frequency; an electronic storage unit 53; a comparator 54 following storage unit 53; a velocity control unit 55; and, an adjusting member or valve 56, for instance, hydraulically operating and acting in accordance with the output of velocity control unit 55 to control the forward velocity V of machine 1. The means 50, 51 supplies measuring data of the incident tie spacing, which data is stored temporarily in storage unit 53. From the measured data there is produced a signal analysis with the desired machine speed. So that the tamping head is positioned correctly to tamp each tie, its speed of operation, that is, the time required to complete one tamping cycle must govern the forward speed of the machine. Thus, the machine must move through the measured tie distance during the time it takes to complete a tamping cycle. The temporary data storage in storage unit 53 is necessary because the tie detector 50 is positioned at a distance in front of tamping unit 12, however, the control signal for working unit 12 is only initiated when the tamping tools have reached the appropriate position, that is, the tie 15 is to be tamped. Comparator 54 compares the signal of desired machine velocity from storage 53 with the actual machine velocity signal from the feed back loop and a null balancing output signal is generated by comparator 54 which output signal controls, by means of control device 55, the adjustor of valve 56 and, hence the required forward velocity of the machine.

At the end of each tamping cycle, a signal caused by the upper workhead position detector 57 (e.g. a limit switch) is sent to storage unit 53. For instance, a tamping cycle could be defined as the time passed between two successive lifting operations of the tamping head 12, that is, between the time at which tamping head 12 has reached the lifted position as shown in dotted lines in FIG. 3 and the time at which the tamping head again has reached its upper position after having tamped tie 15. This is why the detector 57 always reacts when the tamper 12 has reached its upper limit position. Storage unit 53 causes in its outward line 58 a startng signal when, in accordance with the discussed measurements, workhead 12 should start a new tamping cycle and when detector 57 has recorded the end of the preceding tamping cycle. Simultaneously, the old value in the storage 53 will be erased.

For reasons of operational safety, there is yet another tie detector 59 provided which is shown schematically in FIG. 3, and installed such that it could control whether the machine 1 has reached the correct postion above tie 15 before workhead 12 is lowered, so that when lowering the tamping tools they will safely penetrate on each side of the tie into the ballast. If the presence of this tie is not detected, or not early enough, recorded by the tie detector 59 in the area in front of tamping unit 12, the initiation of a new tamping cycle will be prevented or delayed, or the tamping cycle will be interupted in case it has already started. For instance, the control can function such that the starting signal of tie detector 59 and the starting signal in line 58 will have to pass through an "and" gate 60 so that the output 61 will only cause a cycle initiating signal if both input signals are available. When the first phase of a tamping cycle consists of the forward motion of the lifted workhead, the control circuit has to take into consideration the short delay between initiation of the tie signal and the lowering of the workhead, that is, the distance being travelled during this delay. Of course, a tamping cycle can also start with the lowering of the tamping head after it has been swung into the forward position. In this case, the cycle end signal will be produced by a detector which records the moment when the tamping unit has reached its forward position and the tie detector acting as proximity detector is in the area where the tamper is to be lowered, so that for the purpose of initiating the next tamping cycle, the presence of the tie to be tamped will be reported, whenever this is under the workheads.

The above described control adjusts the forward velocity of the machine to the prevailing tie distance, the tie distances may, of course, vary and should the tie spacing decrease or increase the forward velocity will accordingly either be decreased or increased.

Figure 4:
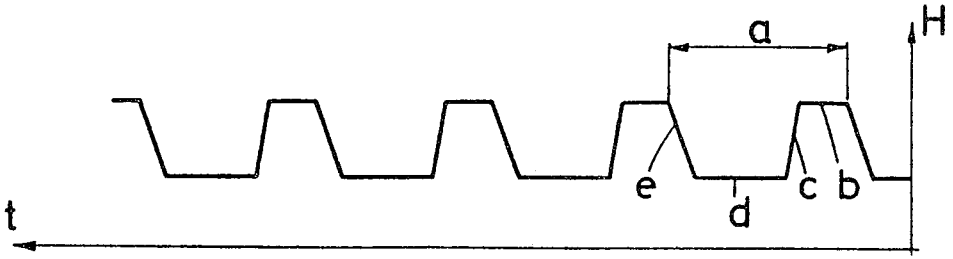
FIG. 4 is a diagram graphing the vertical movement of the tamping head as a function of time.

A typical working cycle, as shown in FIG. 4, is a=3.6 seconds. A tamping cycle in accordance with FIG. 4 will consist of the following phases: upon the initiation signal on output line 61 the control cylinder 34 (FIG. 2) will be actuated and the sub-frame 20, including the tamping unit 12, will quickly be swung forward along distance b, (FIG. 4) relative to frame 2 of machine 1, the workhead being approximately above the tie 15 to be tamped. Subsequently, the actuation of the hydraulic cylinder 19 will cause the lowering of the tamping unit 12 along the distance c, whereby tamping tools 16 enter the ballast bed alongside and on each side of, the appropriate tie 15.

Now, the squeeze tamping phase begins during which the tamping tools 16 approach each other by means of the hydraulic cylinders 52 and simultaneously the workhead 12 including its frame, will swing back relative to frame 2 at a speed depending on the forward speed of machine 1, into a position shown in solid lines in FIG. 2. Such reverse movement does not require any control, it is sufficient to leave the control cylinder 34 in a pressureless "floating" condition so that it can follow the imposed position. During this tamping or squeezing phase, indicated by distance d in FIG. 4, which typically lasts for about 1.8 seconds, the tamping tools 16 stay positioned in the crib while machine 1 moves forward at a uniform velocity. Following this, that is after finishing of the squeeze phase per se, the tamping unit 12 will be lifted again under the action of the hydraulic cylinder 19, while the tools are spread by cylinder 32. This is shown as distance e in FIG. 4, after which the next tamping cycle will be initiated. In the discussed example in FIG. 4 the idle time is very small.

The described swinging motion of workhead 12 about a fixed universal joint suspension on frame 2, about axis 40 and about lateral axis 13, can be controlled more simply and with less control means than the usual translatory sliding motion of the tamping units on special guide rails. Since during the swing motion practically only the lower tamping tools 16 of the tamping unit 12 have to be moved the full distance between two adjacently located ties relative to frame 2, the forces to accelerate the tamping unit are smaller because the effective moment of inertia of such arrangement is smaller than it would be if the entire unit had to be translated from one position to the other on chassis 2. Furthermore, there are no rolling friction forces involved caused by the head rolling along guide rails, as in prior devices.

The control of the tamping cycle can also be done in a different way than as described, for instance, the moving phases of the tamping unit could be a function of the fixed programmed mean working speed of machine 1.

In principle, of course, the entire control can also be done manually which has to be initiated by an operator observing the work process of the machine 1.

Figure 5:
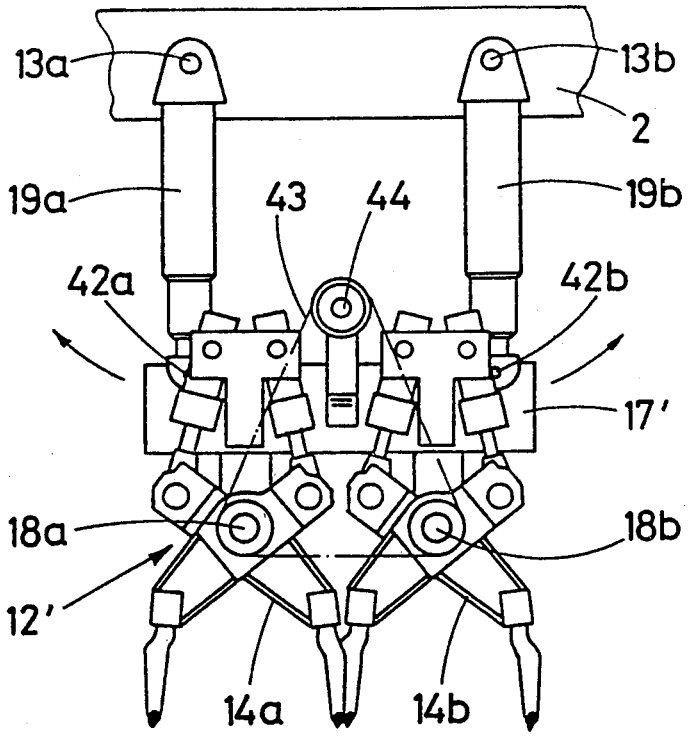
FIG. 5 is a detail of a second embodiment with a double tamping head.

As shown in FIG. 5, the tamping unit 12' can consist of two pairs of tamping tools 14*a*, 14*b* mounted adjacent to each other on a common carrier 17' each pair being basically designated as the one shown and described in FIG. 2. In this case both eccentric shafts 18*a*, 18*b* will be driven by a common motor 44 by means of a belt 43. The carrier 17' is linked by means of both hydraulic cylinders 19*a*, 19*b* at their lower ends at pivot points 42*a*, 42*b* and also linked at the upper ends about the transverse shafts 13*a*, 13*b* fixed to the frame 2 about which cylinders 19*a*, 19*b* can be pivoted, again in a vertical plane longitudinally of the machine in direction of the curved arrow. The parallelogram structure consisting of carrier 17', the two hydraulic cyinders 19*a*, 19*b*, as well as the appropriate part of the machine frame, provides a constant horizontal, and in relation to the track, parallel position of carrier 17', so that both tamping tool pairs 14*a*, 14*b* are always at the same elevation. Furthermore, there could be a frame provided, in accordance with frame 20 in FIG. 2, which is not shown in FIG. 5, which serves as a vertical guide for tamping tools 14*a*, 14*b* and being equipped with centering rollers which revolve on the rail. Such double tie tamping unit in accordance with FIG. 5 permits simultaneous tamping of two adjacently positioned ties. The pendulum amplitude of such tamping unit must then, of course, be twice the prevailing tie distance.

Figure 6:
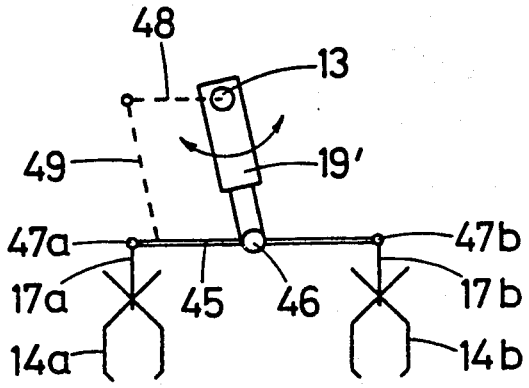
FIG. 6 is a schematic detail of a further embodiment, having a double tamping head.

In accordance with the schematic diagram FIG. 6, an arrangement can be made that each adjacent pair of tamping tools 14*a*, 14*b* is connected to a rocking bar 45 by means of their individual carrier 17*a*, 17*b* with their connections at 47*a* and 47*b*, the rocking bar being connected to hydraulic cylinders 19' approximately in the middle thereof at 46. At its upper end, this hydraulic cylinder 19' can be pivoted about axis 13 in direction of the double arrow. In order to keep both tool pairs 14*a*, 14*b* again at equal elevation, there is a suitable parallel guide provided for rocking bar 45 which could for instance consist of a parallelogram, which is indicated in dotted lines in FIG. 6 and formed by the arms 48, 49 being linked together and by the hydraulic cylinder 19' connected to the appropriate part of the rocking bar.

The invention is not limited to the described embodiments, but it permits many variations, especially with regard to the design of the tamping unit and its pivotal suspension and the control of the tamping cycles.

What I claim as my invention is:

1. In a railroad track tamping machine of the continuous movement type including a machine frame, a tamping unit depending from said machine frame and pendulously mounted thereon about a frame lateral axis, on mounting means; extensible positioning means connected on the one hand to said tamping unit and on the other hand to said frame and adapted to swing the tamping unit, during machine frame track movement, in pendulous fashion forwardly longitudinally of the frame from one track tamping location to a succeeding track tamping location and, in operation, to position said tamping unit at a track tamping location to enable said tamping unit to perform a tamping operation thereat, during machine frame track movement.

2. A machine according to claim 1 in which the mounting means includes a sub-frame mounted in pendulous fashion about said frame lateral axis, said tamping unit having tamping tools mounted on a carrier, and means mounting said carrier for up and down movement in said subframe.

3. A machine according to claim 2 in which said means mounting said carrier on said sub-frame include a pair of vertically extending guide column members of said sub-frame which guide column members carry rail engaging guide roller means at their lower ends.

4. Apparatus as claimed in claim 3 in which said extensible positioning means includes at least one pressure actuator control cyliner adapted to swing said tamping unit in pendulous fashion.

5. Apparatus as claimed in claim 4 in which said control cylinder is articulately mounted at one end to the machine frame and at the other end to one of said guide column members.

6. Apparatus as claimed in claim 1 in which means is provided for permitting pendulous movement of said tamping unit transversely of the machine frame about a frame longitudinal axis.

7. A track tamping machine according to claim 1 characterized in that the tamping unit comprises two pairs of tamping tools mounted one behind the other in direction of machine travel on a common carrier and in that there is a parallel guide for the carrier which carrier is vertically adjustable, pressure cylinders being providing for vertically moving said carrier.

8. A track tamping machine according to claim 1 characterized in that the tamping unit comprises two pairs of tamping tools adjacently mounted in direction of travel, each pair mounted to a carrier and that both carriers are connected at their upper ends with a longitudinally extending rocking beam and in that said rocking beam is equipped with a parallel guide fastened in the center to a pressure actuated cylinder for the vertical movement of the tamping unit, the cylinder being pivotably mounted at its upper end to about said frame lateral axis.

9. A track tamping machine according to claim 7, or claim 8, characterized in the provision of a control system for the automatic control of the tamping unit and the uniform forward velocity of the machine, which system includes tie detector means,
a machine velocity meter,
an electronic storage means,
a velocity comparator means
a control unit actuating an adjustor means for the control of the machine forward velocity,
and a detector means signalling the end of a tamping cycle, whereby machine forward velocity is controllable as a function of the minimum duration of a tamping cycle respectively the measured tie distance, and that a new tamping cycle can be initiated as a function of the tie distance measurement, and the end of a tamping cycle signal.

10. A track tamping machine according to claim 1 characterized in the provision of a control system for the automatic control of the tamping unit and the uniform forward velocity of the machine, which system includes tie detector means,
a machine velocity meter,
an electronic storage means,
a velocity comparator means
a control unit actuating an adjustor means for the control of the machine forward velocity,
and a detector means signalling the end of a tamping cycle, whereby machine forward velocity is controllable as a function of the minimum duration of a tamping cycle respectively the measured tie distance, and that a new tamping cycle can be initiated as a function of the tie distance measurement, and the end of tamping cycle signal.

11. A tamping machine according to claim 10 further comprising a second tie detector which provides a signal of the presence, beneath the tamping unit, of the tie to be tamped.

12. A tamping machine according to claim 1 characterized in that it is equipped with roller type tongs which are constantly controlled and in constant engagement with track rail for continuous levelling and lateral alignment of the track.

* * * * *